US012173518B2

(12) United States Patent
Buchcic

(10) Patent No.: US 12,173,518 B2
(45) Date of Patent: Dec. 24, 2024

(54) CONJOINING APPARATUS AND ROTARY MACHINE ASSEMBLY COMPRISING SAME

(71) Applicant: Mariusz Buchcic, Tecumseh (CA)

(72) Inventor: Mariusz Buchcic, Tecumseh (CA)

( * ) Notice: Subject to any disclaimer, the term of this patent is extended or adjusted under 35 U.S.C. 154(b) by 294 days.

(21) Appl. No.: 17/617,998

(22) PCT Filed: Jun. 12, 2020

(86) PCT No.: PCT/CA2020/050822

§ 371 (c)(1),
(2) Date: Dec. 10, 2021

(87) PCT Pub. No.: WO2020/248074

PCT Pub. Date: Dec. 17, 2020

(65) Prior Publication Data

US 2022/0251857 A1 Aug. 11, 2022

Related U.S. Application Data

(60) Provisional application No. 62/860,404, filed on Jun. 12, 2019.

(51) Int. Cl.
*E04F 21/24* (2006.01)
*E01C 19/42* (2006.01)

(52) U.S. Cl.
CPC ..... *E04F 21/248* (2013.01); *E01C 19/42* (2013.01)

(58) Field of Classification Search
CPC ..... E01C 19/42
USPC ..... 404/112
See application file for complete search history.

(56) References Cited

U.S. PATENT DOCUMENTS 2,887,934 A 5/1959 Whiteman
2,888,863 A 6/1959 Eisenbeis
3,893,286 A * 7/1975 Buttram ..... A01D 51/002 15/82
3,936,212 A 2/1976 Holz, Sr. et al.
3,942,215 A * 3/1976 Olds ..... A47L 11/4038 15/340.4
4,046,484 A 9/1977 Holz, Sr. et al.
4,654,918 A * 4/1987 Cooper ..... A47L 11/4058 15/49.1

(Continued)

FOREIGN PATENT DOCUMENTS

GB 1068697 A 5/1967

OTHER PUBLICATIONS

International Search Report issued on corresponding PCT Application No. PCT/CA2020/050822 dated Aug. 21, 2020, 4 pages.

*Primary Examiner* — Gary S Hartmann

(57) ABSTRACT

A conjoining apparatus for connecting first and second rotary machines to treat a surface, such as rotary cement trowels, or machines used to polish, wax or clean flooring. The conjoining apparatus includes a first bracket assembly comprising a first bracket member and a first connecting mechanism, a second bracket assembly comprising a second bracket member and a second connecting mechanism, and a conjoining frame configured for removable attachment to the first and second bracket assemblies via the respective connecting mechanism. A rotary machine assembly includes a first rotary machine and the conjoining apparatus with the first bracket assembly pivotably connected to the conjoining frame. An adaptor kit including the conjoining apparatus is also provided.

14 Claims, 6 Drawing Sheets

(56) References Cited

U.S. PATENT DOCUMENTS 4,775,306 A 10/1988 Kikuchi et al.
5,238,323 A * 8/1993 Allen ..... E04F 21/247 404/112
5,882,249 A * 3/1999 Ferland ..... E04F 21/248 451/359
5,909,981 A * 6/1999 Neuber, Jr. ..... E04F 21/247 404/112
7,261,623 B1 * 8/2007 Palushi ..... B24B 47/12 451/353
7,765,630 B2 * 8/2010 Flora ..... A01D 51/002 15/82
D662,523 S * 6/2012 Goentzel ..... D15/27
8,282,445 B2 * 10/2012 Goldberg ..... A47L 11/4075 451/353
8,393,937 B2 * 3/2013 Goldberg ..... B24B 7/186 451/353
8,430,178 B2 * 4/2013 McCurdy ..... A01D 34/74 172/59
8,678,883 B2 * 3/2014 Strickland ..... A47L 11/16 451/350
9,623,534 B2 * 4/2017 Johnson ..... B24B 7/18
9,770,801 B2 * 9/2017 Lilienberg ..... B24B 27/0076
2009/0023369 A1 * 1/2009 Thysell ..... B24B 41/047 451/37
2010/0325824 A1 * 12/2010 Baum ..... A01K 1/01 15/87
2013/0084782 A1 * 4/2013 McCutchen ..... B24B 7/186 451/28
2014/0369019 A1 * 12/2014 Sabia ..... B24B 23/005 361/828
2018/0094444 A1 * 4/2018 Ceritano ..... E04F 21/248

* cited by examiner

CONJOINING APPARATUS AND ROTARY MACHINE ASSEMBLY COMPRISING SAME

FIELD OF THE INVENTION

The disclosure herein relates to apparatus and methods for conjoining rotary machines such as rotary cement trowels.

BACKGROUND

Deployment of rotary machines, for example, for leveling concrete when poured in a generally fluid state, typically requires manual labor for supporting and advancing the rotating blades or propellers over the work surface. Sustaining a consistent and even operation of such apparatus over long periods of time and over large surface areas results in significant manual operator fatigue, due to the effort and forces that must be consistently applied to maintain even coverage over the work surface, and also to counteract reactive forces and rotational or moment effects resulting from rotating components of the machines in operation.

As are known in the art, motor-powered rotary trowels are used to finish the surface of a bed of cement. A typical rotary trowel comprises an array of rotary blades arranged so that when the blades are in contact with the concrete surface, rotation of the blades has the effect of trowelling the concrete surface.

Motor powered rotary cement trowels may be provided having one, two or even three sets of rotary trowel blades.

For example, U.S. Pat. Nos. 2,888,863 and 4,320,986 disclose non-riding, motor-powered trowels having only one set of trowel blades, and U.S. Pat. No. 2,887,934 discloses a non-riding, motor-powered trowel having two sets of trowel blades located one behind the other. U.S. Pat. No. 4,046,484, as another example, discloses a riding type motor-powered trowel having two sets of trowel blades in a side-by-side arrangement. U.S. Pat. No. 3,936,212, in a still further example, illustrates a riding-type, motor-powered trowel having three sets of trowel blades.

Although dual rotary machines are known and are beneficial for finishing or treating larger surfaces, it is not always useful to have such a large machine for finishing smaller surfaces. Therefore there is a need for a mechanism for temporarily converting two single rotary machines into one dual rotary assembly, thereby providing the user with access to a dual rotary machine without requiring the financial outlay to purchase a large device that may not be suitable for many smaller jobs. There is also a need for a simple apparatus that provides flexibility in converting between single and dual configurations as desired.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a conjoining apparatus and rotary machine assembly comprising same. In accordance with an aspect of the present invention, there is provided a rotary machine assembly configured to be conjoined to a second rotary machine to form a dual rotary assembly, the rotary machine assembly comprising: a first rotary machine comprising: a support frame, an array of rotary elements configured to contact a surface, a motor operable to rotate the array of rotary elements, the motor being mounted on the support frame, and a handle mounted on the support frame; a conjoining apparatus comprising: a conjoining frame, and a first bracket assembly comprising a first bracket member and a first connecting mechanism, the first bracket assembly being mounted on one side of the support frame of the first rotary machine, wherein the first bracket assembly is pivotably connected to the conjoining frame; and a second bracket assembly comprising a second bracket member and a second connecting mechanism; wherein the conjoining frame is configured for removable attachment to a bracket assembly on the second rotary machine.

In accordance with another aspect of the present invention, there is provided a conjoining apparatus for connecting first and second rotary machines, each of the rotary machines comprising a respective support frame, the conjoining apparatus comprising: a first bracket assembly comprising a first bracket member and a first connecting mechanism; a second bracket assembly comprising a second bracket member and a second connecting mechanism; and a conjoining frame; wherein the conjoining frame is configured for removable attachment to the first and second bracket assemblies via a respective connecting mechanism.

In accordance with another aspect of the present invention, there is provided an adaptor kit for converting two rotary machines into a dual rotary assembly, the kit comprising the conjoining apparatus in accordance with the present invention, and instructions for installation and use.

In accordance with another aspect of the present invention, there is provided a method of conjoining a pair of rotary machines, the method comprising: securing a first end of a conjoining frame in accordance with the present invention onto a first rotary machine of the pair by attachment to a first bracket assembly mounted on the first rotary machine; and securing a second end of the conjoining frame onto a second rotary machine of the pair by attachment to a second bracket assembly mounted on the second rotary machine, the second end being distally located from the first end.

DETAILED DESCRIPTION OF THE INVENTION

Figure 1:
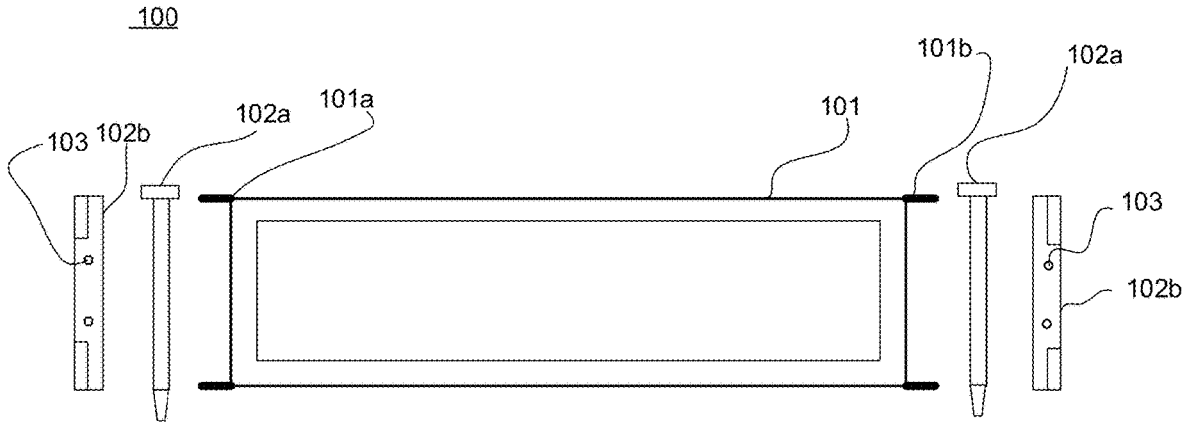
FIG. 1 illustrates a configuration of conjoining apparatus used in assembling rotary machines for deployment in conjoined operation, in accordance with one embodiment of the present invention.

The term "rotary machine", as used herein, means a machine comprising the combination of an array of rotary elements configured to contact a surface, a support frame to support the rotary elements and a motor operable to rotate the rotary element. The support frame comprises a handle which in use is grasped by an operator so that the operator can direct the rotary machine over the surface being treated.

The term "rotary trowel machine" is used herein to mean the combination of an array of rotary blades configured to trowel a concrete surface, a support frame to support the blades and a motor operable to rotate the blades. The support frame comprises a handle which in use is grasped by an operator so that the operator can direct the power trowel over the concrete surface.

Unless defined otherwise, all technical and scientific terms used herein have the same meaning as commonly understood by one of ordinary skill in the art to which this invention belongs.

The disclosure herein relates to the use of a conjoining apparatus for connect two rotary assemblies to form a dual rotary assembly.

The disclosure herein also pertains to a novel method for conjoining and simultaneously operating at least a pair of rotary machines using a conjoining apparatus. In embodiments, the machines may be arranged in a serial or parallel configuration, where such configuration may enable usage in a manner that results in less manual fatigue, enhancing overall consistency and quality of operational performance over a large work surface for extended periods of time.

Although dual rotary machines are known and are beneficial for finishing or treating larger surfaces, it is not always useful to have such a large machine for finishing smaller surfaces. The present invention therefore provides a mechanism for temporarily converting two single rotary machines into one dual rotary assembly, thereby providing the user with access to a dual rotary machine without requiring the financial outlay to purchase a large device that may not be suitable for many smaller jobs. The present invention therefore provides the user with a simple apparatus that provides flexibility in converting between single and dual configurations as desired. Dual rotary machines are also very heavy and require heavy machinery to transport to and around job sites. The dual rotary assemblies that can be assembled using the present invention can readily be disassembled for easy transport.

In one aspect of the present invention, there is provided a conjoining apparatus that includes all components required to provide a connection between two rotary machines, including bracket assemblies that are configured to be attached to the respective rotary machines, and a conjoining frame that extends between the bracket assemblies.

In one embodiment, there is provided a rotary machine assembly configured to be conjoined to a second rotary machine to form a dual rotary assembly. In one embodiment, the rotary machine assembly comprises a first rotary machine and a conjoining apparatus mounted on the first rotary machine. The first rotary machine comprises a support frame, an array of rotary elements configured to contact a surface, a motor operable to rotate the array of rotary elements, the motor being mounted on the support frame, and a handle mounted on the support frame.

The conjoining apparatus comprises a conjoining frame, and a first bracket assembly comprising a first bracket member and a first connecting mechanism, the first bracket assembly being mounted on the support frame of the first rotary machine, wherein the first bracket assembly is pivotably connected to the conjoining frame. The conjoining frame is configured for removable attachment to a bracket assembly mounted on the second rotary machine, wherein upon attachment to the second rotary machine, the dual rotary assembly is formed.

A second bracket assembly comprising a second bracket member and a second connecting mechanism is also provided. In one embodiment, the second bracket assembly is mounted on an opposing side of the support frame of the first rotary machine. Accordingly, in this embodiment, the rotary machine assembly comprises a bracket assembly mounted on both the front and rear sides of the rotary machine, where the bracket assembly mounted at the front is configured to receive a conjoining frame from another rotary machine assembly.

In another embodiment, the second bracket assembly is to be mounted on the second rotary machine, to receive the conjoining frame that is pivotably attached to the first rotary machine.

In one embodiment, the rotary machine assembly is convertible between a deployment configuration and a storage configuration. In the deployment configuration, the conjoining frame on the first rotary machine is lowered into a horizontal position to allow the second end to be attached to a corresponding bracket assembly on the second rotary machine to facilitate connection to form the dual rotary assembly.

In the storage configuration, the conjoining frame on the first rotary machine is detached from the bracket assembly on the second rotary machine and raised out of the deployment position and into the storage position. In one embodiment, the conjoining frame is retained in the storage position by a retaining mechanism provided on the handle of the first rotary machine.

Accordingly, in some embodiments, the conjoining apparatus comprises a first end that is secured to a first rotary machine of a pair of machines, and a second end that is detachably secured to a second rotary machine of the pair, the second end being distally located from the first end. In one embodiment, the conjoining apparatus is detachably secured at its first end to the first rotary machine.

In accordance with one embodiment of the present invention, the conjoining frame is attached to the respective rotary machine via a bracket assembly comprising a bracket member and a connecting mechanism. In a preferred embodiment, the bracket member is attached to the support frame of the rotary machine. Accordingly, each conjoining apparatus comprises a first and second bracket assembly, each being configured for mounting on a respective rotary machine support frame.

The bracket assemblies may be mounted on the support frame by any suitable means. In one embodiment, the bracket assemblies are reversibly mounted on the respective support frames, for example, by a bolted attachment or the like. In one embodiment, the bracket assemblies are permanently mounted on the respective support frames, for example, by a welded attachment. In one embodiment, the first bracket assembly is permanently attached to the first rotary machine.

Although it is a preferred embodiment that the bracket assembly is attached to the rotary machine support frame, it is within the scope of the present invention that the bracket assembly may be attached to any other component of the rotary machine. It is also within the scope of the invention that the bracket assemblies are attached to the sides of the rotary machine, such that when two rotary machines are conjoined, they can be operated in a side-to-side configuration.

The conjoining apparatus enables the user to deploy the assembled pair of rotary machines using at least a partially translational motion of the dual rotary assembly over a work surface. In this manner, the conjoining frame allows a single manual operator to operate more than one rotary machine simultaneously, in effect doubling the operator throughput.

Accordingly, in one aspect of the present invention, there is provided a method for forming a conjoined assembly of a pair of rotary machines. The method comprises securing a first end of a conjoining frame onto a first rotary machine of the pair by attachment to a first bracket assembly mounted on the first rotary machine; and securing a second end of the conjoining frame onto a second rotary machine of the pair by attachment to a second bracket assembly mounted on the second rotary machine, the second end being distally located from the first end.

FIG. 1 schematically illustrates the elements of a conjoining apparatus 100 suitable for use in assembling two rotary machines for deployment in conjoined operation.

The conjoined assembly may be formed by securing a first end 101*a* of a conjoining frame 101 onto a first rotary machine of the pair.

A second end 101*b* of the conjoining frame 101 may be secured onto a second rotary machine of the pair, the second end 101*b* being distally located from the first end 101*a*.

In some embodiments, the step of securing of at least one of the first and second ends 101*a*, 101*b* of the conjoining frame 101 comprises detachably securing via a connecting mechanism. In one embodiment, the connecting mechanism is a quick attach and release mechanism.

In one embodiment, as depicted in FIG. 1, the connecting mechanism may comprise a connecting rod 102*a* and bracket member 102*b*, having attachment points 103, for attachment to a rotary machine.

In other embodiments, the connecting mechanism may employ mechanisms including slidable and keyed latch components, positive locking pin assemblies, a quick release ball lock, and the like, or any combination thereof.

In one embodiment, the connecting mechanism comprises a rod, and the bracket member comprises a tubular body adapted to slidably receive the rod.

The components of the conjoining apparatus may be fabricated of any suitable material, including but not limited to, a metal, a polymer, a composite material, or any combination thereof.

In one embodiment, the conjoining apparatus is provided as part of an adaptor kit for converting two rotary machines into a dual rotary assembly. In one embodiment, the kit also comprises instructions for installation of the conjoining apparatus on a first rotary machine, and subsequent connection to a second rotary machine.

In one embodiment, the conjoined rotary machines are for use in treating a work surface. In one embodiment, the work surface may be a concrete aggregate liquid, or slush, as poured during construction operations. In such an embodiment, the rotary machine is a rotary concrete trowel machine.

It is also within the scope of the present invention that the conjoining apparatus may also be applied to connect two rotary machines such as may be used for polishing, waxing or cleaning flooring or other surfaces.

In some embodiments, securing of at least one of the first and second ends of the conjoining frame comprises detachably securing via a quick attach and release mechanism.

In some embodiments, the connecting mechanism is configured to enable a pivotable motion of the conjoining frame relative to at least one of the first and second rotary machines.

In other embodiments, the connecting mechanism may be configured to secure at least one of the first and second ends of the conjoining frame to an external portion, for example, the support frame, of a respective one of the pair of rotary machines.

In an embodiment, deploying the conjoined dual rotary assembly accords, relative to a central vertical axis of the conjoining frame, at least one of a load balanced and a null moment operation of the conjoined assembly over the work surface.

For instance, the load balanced operation may be provided by exerting a support fulcrum at a center portion of the conjoining frame while the machines are engaged in rotational operation, wherein the weight of each machine counterbalances the weight, or drag, of the other relative to the center portion, with less manual operator fatigue resulting.

Yet further, null moment operation may be provided by arranging the machines such that a direction of rotation of each rotational component is opposite to that of the other machine of the pair. Null moment operation as referred to herein means that the tendency of each machine to pivot or turn about the center portion of the conjoining frame cancels or nullifies the other, whereby resultant moment effects are cancelled or minimized, providing less manual operator fatigue while effectively doubling the operator throughput since two machines are being operated simultaneously by a single manual operator.

In one aspect, the conjoining apparatus may be used to configure the pair of rotary machines in a parallel arrangement relative to a direction of translational motion of the conjoined frame across the work surface. In particular, in the parallel arrangement as referred to herein, an axis joining the centers of each machine is perpendicular to a direction of translational motion of the conjoining frame across the work surface.

In another variation, the conjoining apparatus may be used to configure the pair of rotary machines in a series configuration relative to a direction of the translational motion across the work surface. In the series arrangement as referred to herein, an axis joining the centers of each machine is parallel to a direction of translational motion of the conjoining frame across the work surface.

In some embodiments, the conjoining frame comprises a first end that is secured to a first rotary machine of a pair of machines, and a second end that is detachably secured to a second rotary machine of the pair, the second end being distally located from the first end, wherein the conjoined frame conjoins the pair of rotary machines to be deployed via at least a partially translational motion of the dual assembly over a work surface.

It is contemplated for embodiments described herein to extend to individual elements and concepts described herein, independently of other concepts, ideas or system, and also for the embodiments to include combinations of elements recited throughout this application. Although embodiments are described in detail herein with reference to the accompanying drawings, it is contemplated that the invention is not limited to such embodiments. As such, many modifications and variations will be apparent to practitioners skilled in this art.

The invention will now be described with reference to specific examples. It will be understood that the following examples are intended to describe embodiments of the invention and are not intended to limit the invention in any way.

Figure 2A:
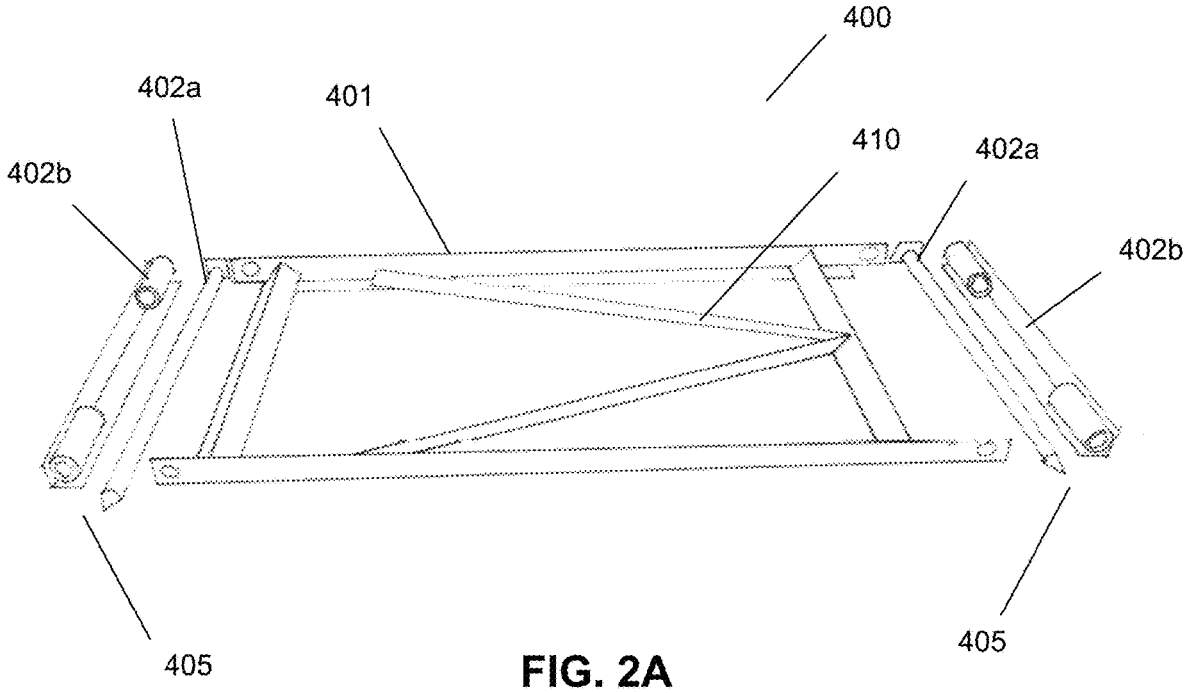
FIGS. 2A and 2B illustrate a conjoining apparatus, in accordance with one embodiment of the present invention, in disassembled (FIG. 4A) and assembled (FIG. 4B) modes.
Figure 2B:
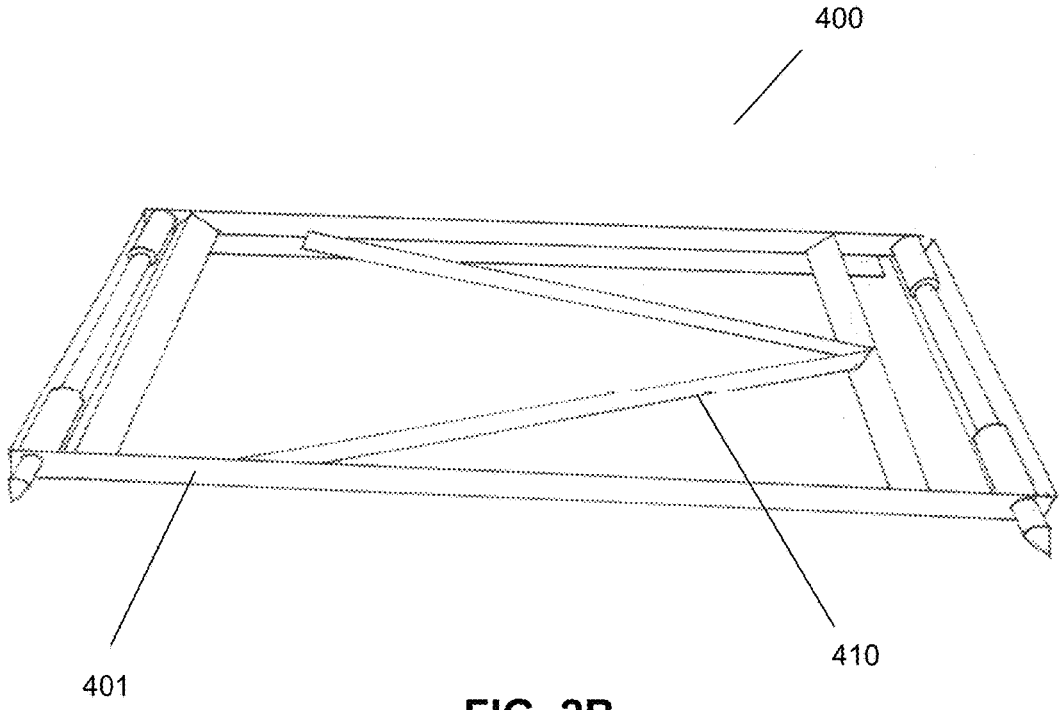

FIGS. 2A and 2B depict one embodiment of a conjoining apparatus 400 in accordance with the present invention, in disassembled (FIG. 2A) and assembled (FIG. 2B) modes, including conjoining frame 401, and two bracket assemblies 405, each including respective bracket members 402*b* and connecting rods 402*a*. Conjoining frame 401, in this embodiment, conjoining frame 401 includes a cross brace element 410.

Figure 3:
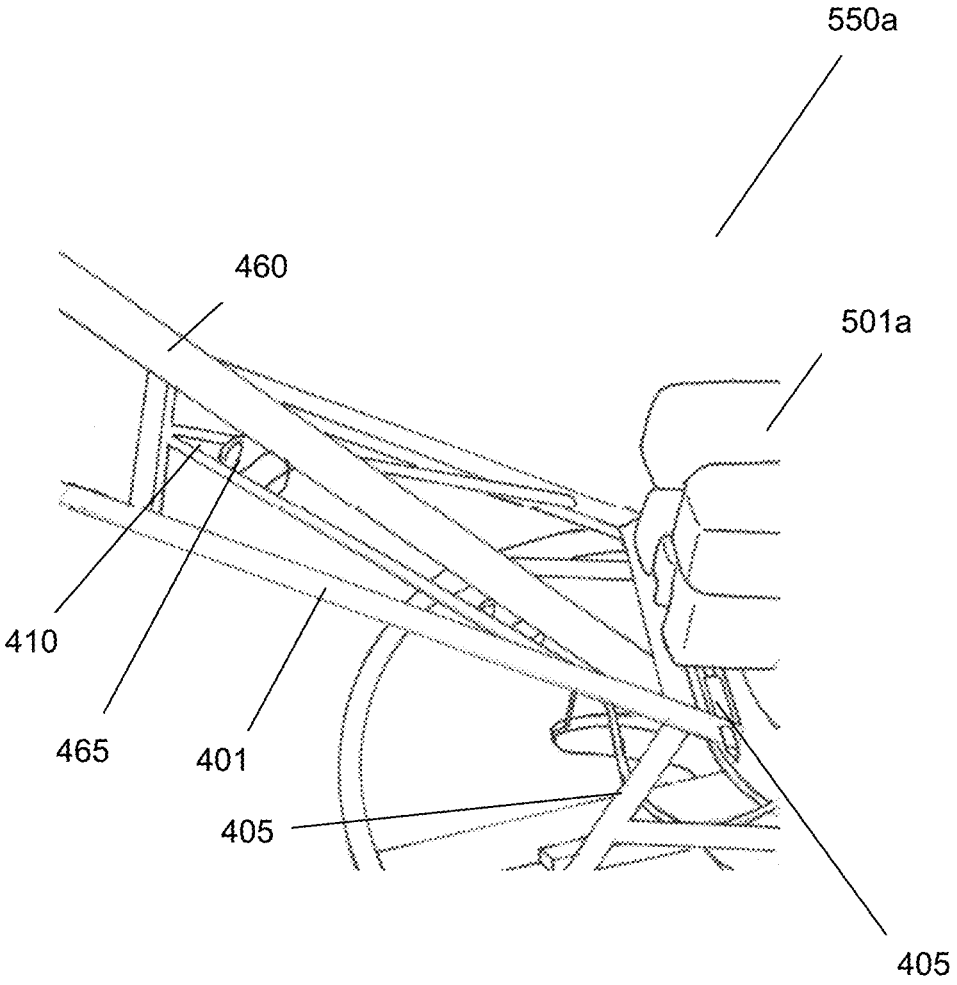
FIG. 3 illustrates a rotary machine assembly with the conjoining frame in a storage position, in accordance with one embodiment of the present invention.

FIG. 3 depicts rotary machine assembly 550*a* with conjoining frame 401 in a storage position, attached to a first rotary machine 501*a* via bracket assembly 405. In the storage position, conjoining frame 401 is raised out of the deployment position and held against handle 460 for convenient storage. In the embodiment depicted in FIG. 3, cross brace element 410 frictionally engages protrusion 465 on handle 460, thus allowing conjoining frame 401 to be retained in the storage position.

Figure 4:
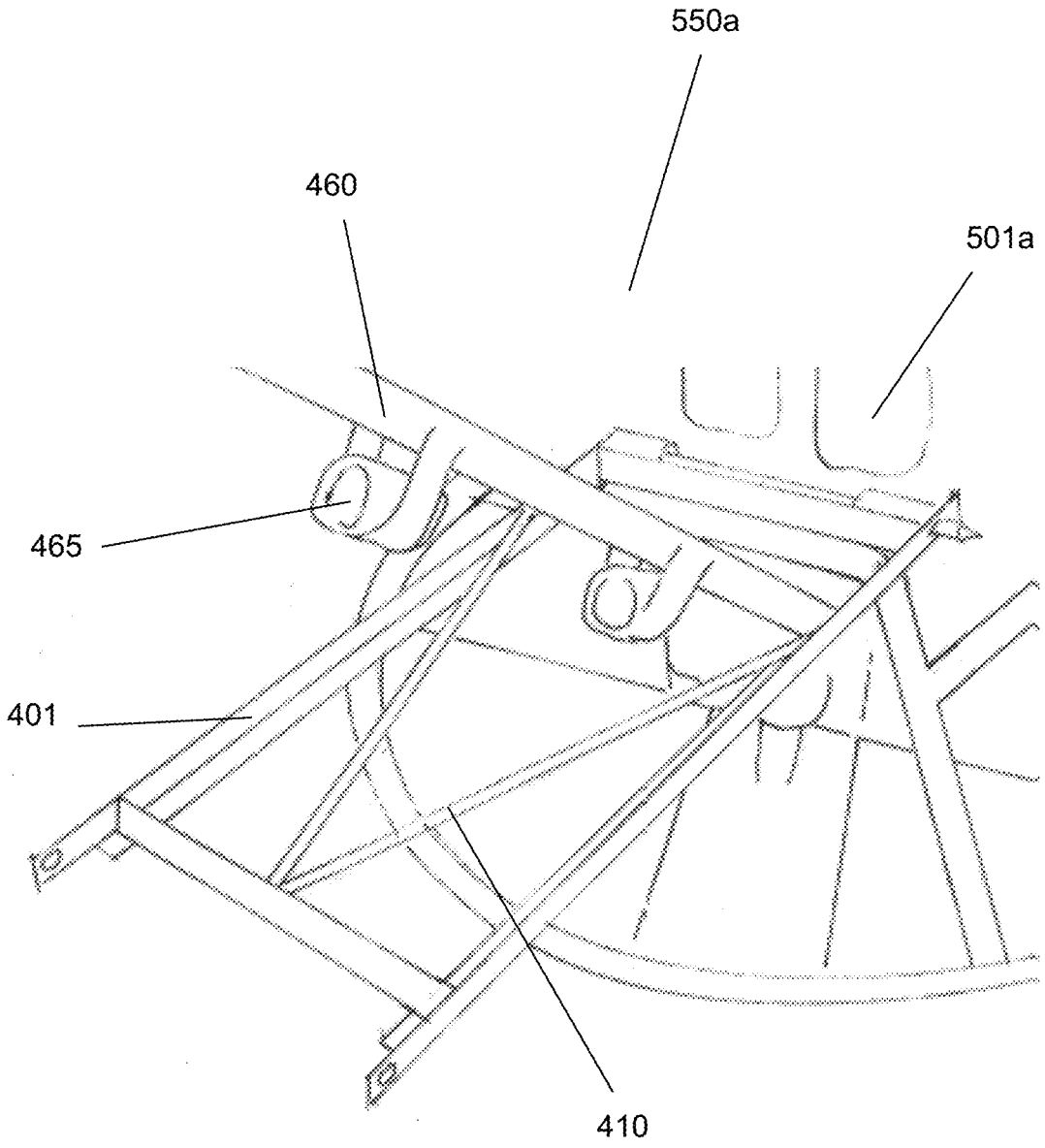
FIG. 4 illustrates a rotary machine assembly with the conjoining frame in a deployment position, in accordance with one embodiment of the present invention.

FIG. 4 depicts rotary machine assembly 550*a* with conjoining frame 401 in a deployment position, attached to a first rotary machine 501*a* via bracket assembly 405. Conjoining frame 401 is in a position ready for attachment to a bracket assembly installed on a second rotary machine 510*b* (not shown).

Figure 5:
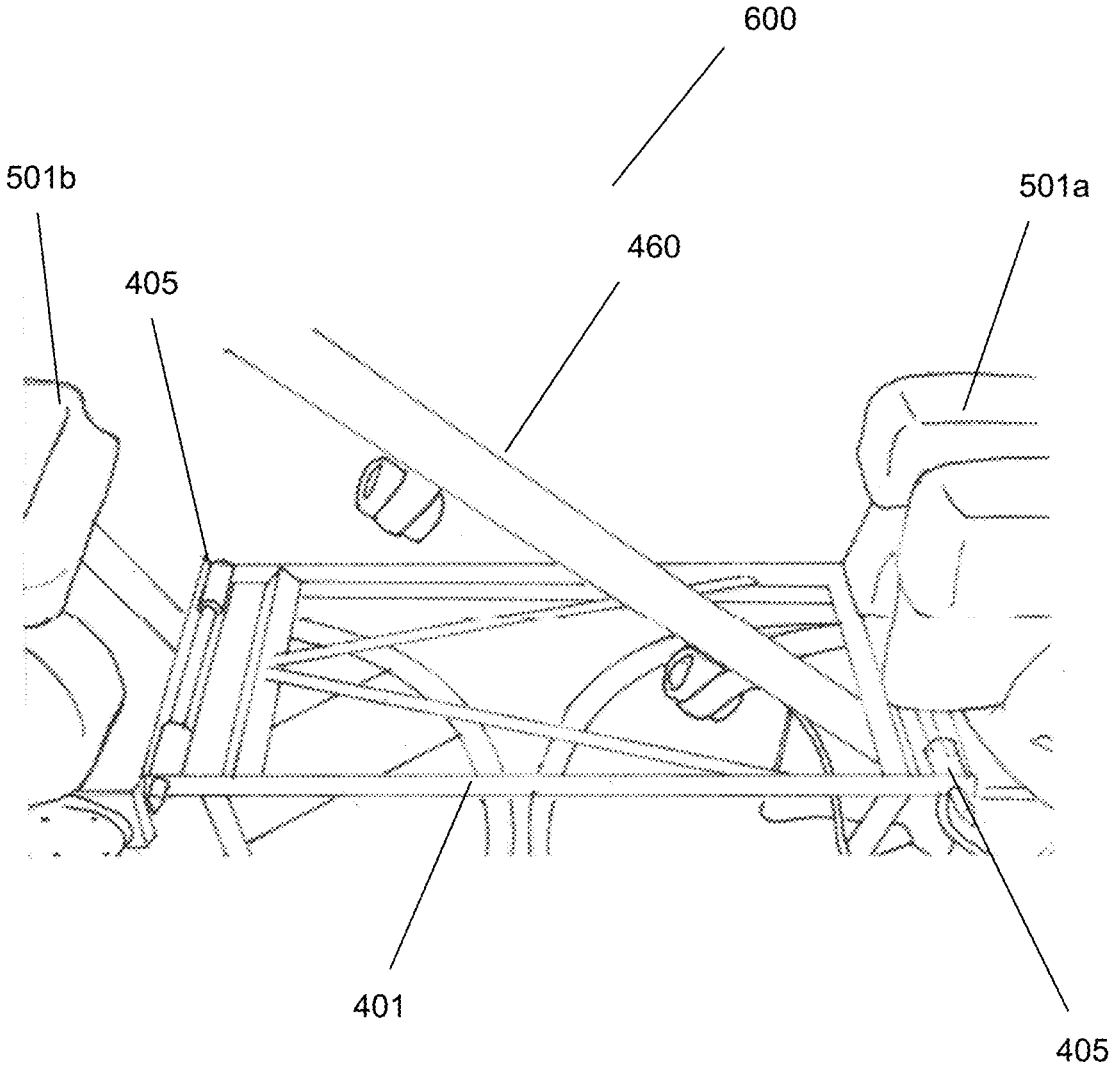
FIG. 5 illustrates a dual rotary assembly comprising a first rotary machine connected to a second rotary machine via a conjoining apparatus, in accordance with one embodiment of the present invention.

FIG. 5 depicts dual rotary assembly 600 comprising first rotary machine 501*a* connected to second rotary machine 501*b* via conjoining apparatus 400 which includes conjoining frame 401 connected to the first and second rotary machines 501*a*, 501*b* by respective bracket assemblies 405.

Figure 6A:
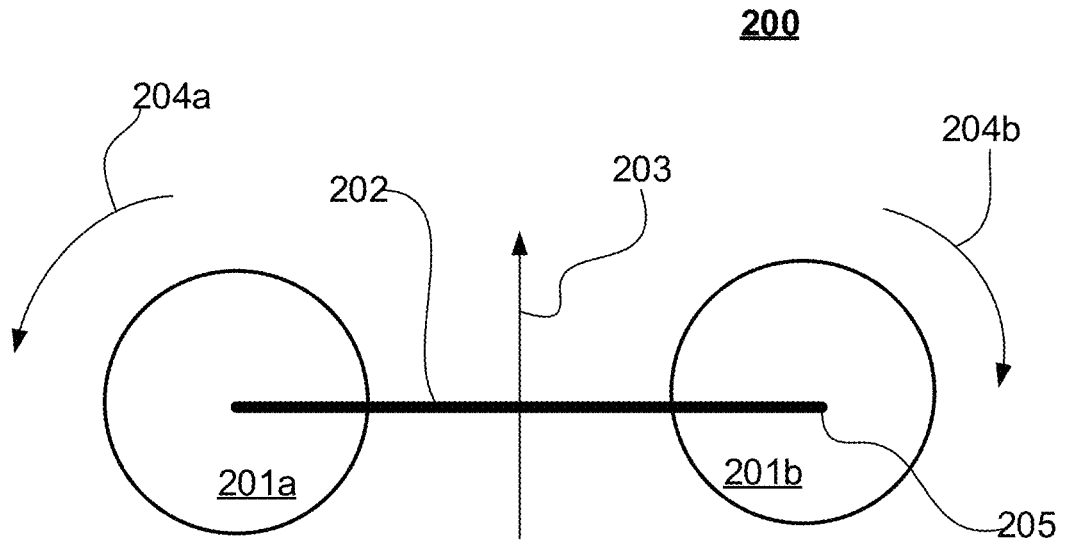
FIG. 6A illustrates a deployment of rotary machines conjoined in a parallel configuration, in accordance with one embodiment of the present invention.

FIG. 6A schematically illustrates a deployment of two rotary machines 201*a*, 201*b* conjoined in a parallel configuration 200.

In the parallel configuration/arrangement, the conjoined frame 101 may be deployed to configure the pair of the rotary machines 201*a*, 201*b* in a parallel arrangement relative to a direction of translational motion 203 of the conjoined frame across the work surface. In particular, in the parallel arrangement as referred to herein, an axis 202 joining the centers of each machine 201*a*, 201*b* may be perpendicular to a direction of translational motion 203 of the conjoining frame across the work surface as depicted in FIG. 6A.

Figure 6B:
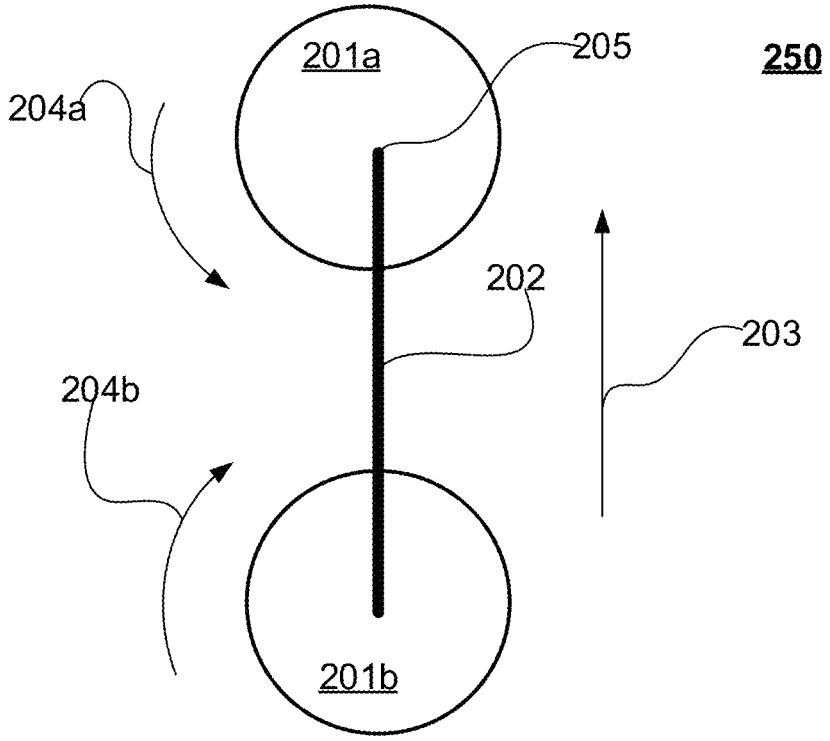
FIG. 6B illustrates a deployment of rotary machines conjoined in a serial or series configuration, in accordance with one embodiment of the present invention.

FIG. 6B schematically illustrates a deployment of rotary machines conjoined in a series configuration 250.

In the series configuration/arrangement as referred to herein, an axis 202 joining the centers of each machine 201*a*, 201*b* may be parallel to a direction of translational motion 203 of the conjoining frame across the work surface as depicted in FIG. 6B.

In an embodiment, deploying the conjoined assembly accords, relative to a central vertical axis 202 of the conjoining frame, at least one of a load balanced and a null moment operation of the conjoined assembly over the work surface.

For instance, the load balanced operation may be provided by exerting a support fulcrum at a center portion of the conjoining frame while the machines are engaged in rotational operation 204*a*, 204*b*, wherein the weight of each machine counterbalances the weight, or drag, of the other relative to the center portion 202, with less manual operator fatigue resulting.

Yet further, null moment operation may be provided by arranging the machines 201*a*, 201*b* such that a direction of rotation 204*a*, 204*b* of each rotational component is opposite to that of the other machine of the pair, as depicted in FIGS. 8A and 8B. Null moment operation as referred to herein means that the tendency of each machine to pivot or turn about the center portion of the conjoining frame which cancels or nullifies the other, whereby resultant moment effects are cancelled or minimized. In this manner, with a relatively minimal counteractive force required at center portion 202 to offset the separate forces or moments of each separate machine, manual operator fatigue is lessened, allowing a single manual operator to operate more than one machines simultaneously, in effect doubling the operator throughput.

In one embodiment, the connecting mechanism is configured to enable a pivotable motion of the conjoining frame 101 relative to at least one of the first and second rotary machines 201*a*, 201*b*. In particular, the connecting mechanism may be configured to allow for a rotation, or pivoting, of the conjoining frame relative to a housing of the rotary machines 201*a*, 201*b*.

In one embodiment, the connecting mechanism may be configured to secure at least one of the first and second ends 101*a*, 101*b* of the conjoining frame 101 to an external portion 205 of a respective one of the pair of the rotary machines 201*a*, 201*b*. In a preferred embodiment, the external portion to which the conjoining frame is attached is the support frame of the rotary machine.

Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no specific mention of the particular combination of features. For instance, it is contemplated that more than a single pair of rotary machines may be conjoined via an assembly of one or more conjoining frames, for deployment in tandem operation. The tandem configuration, in some embodiments, may also provide a load balanced or null moment operation of the conjoined tandem arrangement. Thus, any absence of describing combinations should not preclude the inventors from claiming rights to such combinations It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. A rotary machine assembly configured to be conjoined to a second rotary machine to form a dual rotary assembly, the rotary machine assembly comprising:

a first rotary machine comprising:

a support frame, an array of rotary elements configured to contact a surface, a motor operable to rotate the array of rotary elements, the motor being mounted on the support frame, and a handle mounted on the support frame;

a conjoining apparatus comprising:

a conjoining frame having a first end and a second end, the second end being distally located from the first end, and a first bracket assembly comprising a first bracket member and a first connecting mechanism, the first bracket assembly being mounted on one side of the support frame of the first rotary machine, wherein the first bracket assembly is pivotably and removably connected to the first end of the conjoining frame; and a second bracket assembly comprising a second bracket member and a second connecting mechanism, wherein the second bracket assembly is configured to be mounted on the second rotary machine for pivotable and removable attachment to the second distal end of the conjoining frame;

wherein the conjoining frame is configured for removable attachment to the second rotary machine via the second bracket assembly.

2. The assembly of claim 1, wherein the first and second rotary machines are rotary trowel machines.

3. The assembly of claim 1, wherein the first bracket assembly is mounted on the support frame by a bolted attachment or a welded attachment.

4. The assembly of claim 1, wherein the second bracket assembly is to be mounted on the support frame by a bolted attachment or a welded attachment.

5. The assembly of claim 1, wherein the first and second connecting mechanisms are a quick attach and release mechanism.

6. The assembly of claim 1, wherein the first and second connecting mechanisms comprise a rod, and the first and second bracket member comprises a tubular body adapted to receive the rod.

7. The assembly of claim 1, wherein the conjoining frame is convertible between a deployment position and a storage position.

8. The assembly of claim 7, wherein the conjoining frame is held in the storage position by a retaining mechanism provided on the handle of the first rotary machine.

9. The assembly of claim 1, wherein the conjoining frame and the first and second bracket assemblies are fabricated from at least one of a polymer, a metal, a composite material, and any combination thereof.

10. A conjoining apparatus for use in connecting to respective support frames on first and second rotary machines, the conjoining apparatus comprising:

a conjoining frame having a first end and a second end, the second end being distally located from the first end;

a first bracket assembly configured for attachment at the first end of the conjoining frame, the first bracket assembly comprising a first bracket member and a first connecting mechanism, the first bracket assembly being configured for attachment to the support frame of the first rotary machine; and a second bracket assembly configured for attachment at the second end of the conjoining frame, the second bracket assembly comprising a second bracket member and a second connecting mechanism, the second bracket assembly being configured for attachment to the support frame of the second rotary machine;

wherein the conjoining frame is configured for removable and pivotable attachment to the first and second bracket assemblies via a respective connecting mechanism.

11. The conjoining apparatus of claim 10, wherein the first and second bracket assemblies are mounted on the respective support frames by a bolted attachment or a welded attachment.

12. The conjoining apparatus of claim 10, wherein the connecting mechanism is a quick attach and release mechanism.

13. The conjoining apparatus of claim 10, wherein the connecting mechanism comprises a rod, and the bracket member comprises a tubular body adapted to receive the rod.

14. The conjoining apparatus of claim 10, wherein the conjoining frame and the first and second bracket assemblies are fabricated from at least one of a polymer, a metal, a composite material, and any combination thereof.

* * * * *